US007007627B1

(12) United States Patent
Allen

(10) Patent No.: US 7,007,627 B1
(45) Date of Patent: Mar. 7, 2006

(54) MATERIAL RECEIVING AND RETAINING BIB AND QUICK ATTACHABLE/DETACHABLE FRAME ASSEMBLY

(76) Inventor: Scott Van Allen, 207 NE. 12th Ave., Fort Lauderdale, FL (US) 33301

( * ) Notice: Subject to any disclaimer, the term of this patent is extended or adjusted under 35 U.S.C. 154(b) by 0 days.

(21) Appl. No.: 11/003,088

(22) Filed: Dec. 3, 2004

Related U.S. Application Data

(60) Provisional application No. 60/577,805, filed on Jun. 8, 2004.

(51) Int. Cl.
*B63B 17/00* (2006.01)
*B05B 15/04* (2006.01)
*B05C 11/11* (2006.01)

(52) U.S. Cl. ..... 114/343; 118/505; 239/121

(58) Field of Classification Search ..... 114/343, 114/361; 118/504, 505; 296/38; 220/573; 239/120, 121, 122
See application file for complete search history.

(56) References Cited

U.S. PATENT DOCUMENTS

| | | | | |
|---|---|---|---|---|
| 3,172,419 | A * | 3/1965 | Lewis | 135/119 |
| 3,307,518 | A * | 3/1967 | Norton | 118/505 |
| 4,005,678 | A * | 2/1977 | O'Toole | 118/505 |
| 4,862,822 | A * | 9/1989 | Michalowski | 114/364 |
| 5,213,055 | A * | 5/1993 | Hofbauer | 114/222 |
| 6,026,761 | A * | 2/2000 | Parniske et al. | 114/343 |
| 6,065,420 | A * | 5/2000 | Smith | 114/343 |
| 6,595,155 | B1 * | 7/2003 | Akers | 114/361 |

* cited by examiner

*Primary Examiner*—Andrew D. Wright
(74) *Attorney, Agent, or Firm*—Daniel S. Polly, P.A.

(57) ABSTRACT

A material receiving and retaining bib and quick attachable/detachable frame assembly for positioning the bib in a desired location for receipt of material (i.e. varnish, cleaners, paints, etc.) which may run off of a surface being treated. The frame assembly includes a plurality of frame members attached to the surface. The retaining bib is held in place by the frame member. The bib is positioned such that it will catch and retain excess materials falling from the object being serviced such as, but not limited to, a wooden rail or any another item of the marine vessel.

20 Claims, 6 Drawing Sheets

MATERIAL RECEIVING AND RETAINING BIB AND QUICK ATTACHABLE/DETACHABLE FRAME ASSEMBLY

This application claims the benefit of and priority to U.S. Application Ser. No. 60/577,805, filed Jun. 8, 2004, which is incorporated by reference.

BACKGROUND OF THE INVENTION

1. Field of the Invention

This invention relates generally to a material receiving and retaining bib having a quick attachable/detachable frame assembly for positioning the bib in a desired location for receipt of material (i.e. fluids, excess varnish, paints, compositions, chemicals, etc.) which may drip or fall off of the surface (i.e. handrail, etc.) to which the material is being applied to.

2. Description of Related Art

When the wooden rails or other wood portions of a marine vessel are treated such as by varnishing, excess varnish or other compositions, chemicals, paints, materials and fluids (all collectively referred to as "materials"), may be applied and often drip, run or fall off from the rail or other object being treated on the marine vessel. Often the excess material falls on the floor or other area of the marine vessel requiring it to be cleaned or otherwise removed or possibly staining the area. Additionally, depending on the location of the wood or other object to be treated on the marine vessel, excess material may also drip into the water thus causing potential pollutants to enter the water with obvious known hazards that may occur by their water entry. Additionally, permitting the excess material to enter a body of water often is in violation of State or Federal regulations, law, orders, etc.

It is therefore a need in the art for a material catching and retaining assembly which will overcome the problems discussed above. Accordingly, the present invention provides such assembly.

SUMMARY OF THE INVENTION

The present invention provides material receiving and retaining bib having a quick attachable/detachable frame assembly for positioning the bib in a desired location for receipt of material (i.e. fluids, excess varnish, cleaners, paints, compositions, chemicals, etc.) which may drip or fall off of the surface (i.e. handrail, etc.) to which the material is being applied to. The frame assembly includes a plurality of quickly attachable/detachable frame members that are quickly and easily attached to a surface of a marine vessel or other location and a retaining bib, tray, apron, drop cloth, large piece of plastic, other objects that will catch and retain the falling material, etc. (collectively referred to a "bib") which is held in place by the frame member. The bib is positioned such that it will catch and retain excess materials falling from the object being serviced or treated such as a wooden rail or any another item of the marine vessel.

In one non-limiting example, the material is excess varnish that may drip or otherwise fall from a wooden rail located on the marine vessel. However, other materials can also be caught and retained by the present invention and are all considered within the scope of the invention.

Preferably, the frame members are attached to the marine vessel or other object at a spaced-apart distance from each other. Several methods can be used for attaching frame assemblies to the marine vessel and include but are not limited to a magnetic assembly disposed on one or more ends of each frame members, hook and loop fastening assemblies attached to the frame members and to the marine vessel, double-sided tapes, tie ropes and cables used around a post, pole, staunchin, etc. on the vessel or other object and inserted through one of the holes in the frame members, hot glues and adhesives alone or in conjunction with tape on the vessel to protect the surface of the vessel. Various conventional devices can be used for attaching the retaining bib to the frame such as hot fluid adhesives, double-sided tapes, hook and loop fasteners, tie ropes, cables, etc. and other conventional fashion can also be included and are considered within the scope of the invention.

In use the frame members are attached to the desired location of the marine vessel or other object such that they are positioned underneath the area of the boat to be serviced. Once the frame members are attached by one of the above-described methods or some other conventional method, the bib is then attached to the frame member by one of the above-described methods or some other conventional method. Alternatively, the bib itself can be self adhesive for attaching to the frame members. Any excess material dripping from the treated object is caught and retained within the bib prior to touching a non-desired area of the vessel or before entering a body of water the vessel may be residing in. Thus, the present invention eliminates the problems associated with the prior art.

Thus, the present invention provides a quickly removable and easily attachable frame assembly for holding a drip tray or other fluid retaining device (i.e., drip bib, etc.). The frame members can be attached at various locations along a boat hull or other surface area in order to catch any dripping varnish or other material which may be dripping or falling (i.e. from a yacht's cap rail being varnished, etc.). Without the tray or bib in place any varnish which is dripping or running from the cap rail may end up polluting the water where the yacht is located in.

As an example, where used to catch dripping varnish from a yacht's cap rail, a plurality of the frame members can be attached to the boat hull underneath the cap rail and the drip tray or bib is then disposed within the J-shaped grooving of the frame members. Where a boat hull is constructed from metal, a magnetic strip can be provided on one end of the framework for attaching the framework to the boat hull. Alternatively, a first piece of hook and loop (Velcro) can be used and attached to the frame member and a mating hook and loop material can be adhered to the boat hull. The frame members are then connected to the boat hull by mating the hoop and loop fasteners together. Double sided tapes, hot glue, and other adhesives can also be used to attach the frame members to the boat hull or other surface in a non-invasive manner (i.e. without having to drill holes into the boat hull or other surface).

The opposite edge of the frame members can also contain a magnetic strip (or other attachment methods as discussed above) and can also be rounded in shape as opposed to substantially planar. This edge can be used for retaining the frame members to a rounded surface. At least one hole can be also provided in the frame members work for feeding a line or other cord-like material. The use of the line or cord-like material through the various frame members can aid in retaining a frame members from falling (such as into the water) in case it gets disconnected from the boat hull or other surface it may be attached to.

The instant invention will now be described with particular reference to the accompanying drawings.

DETAILED DESCRIPTION OF THE INVENTION

Figure 1:
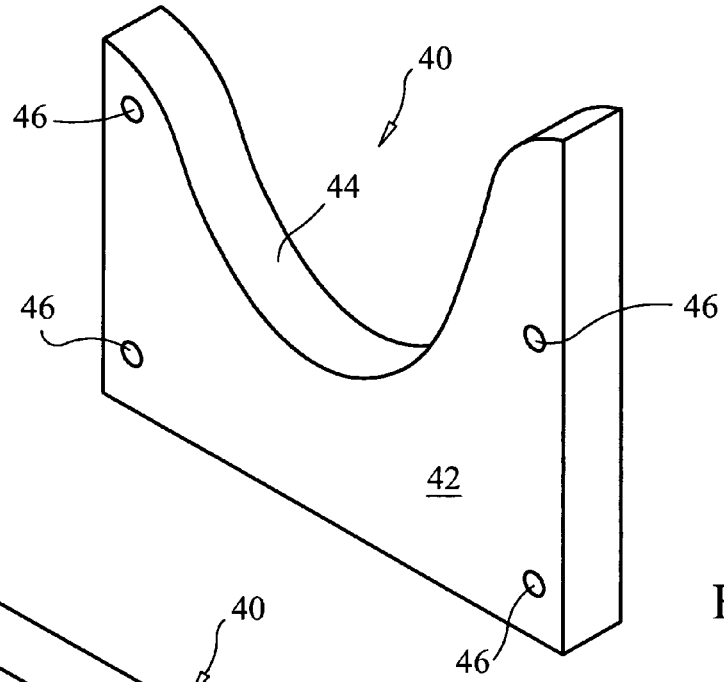
FIG. 1 is a perspective view of a frame member in accordance with the present invention.
Figure 2:
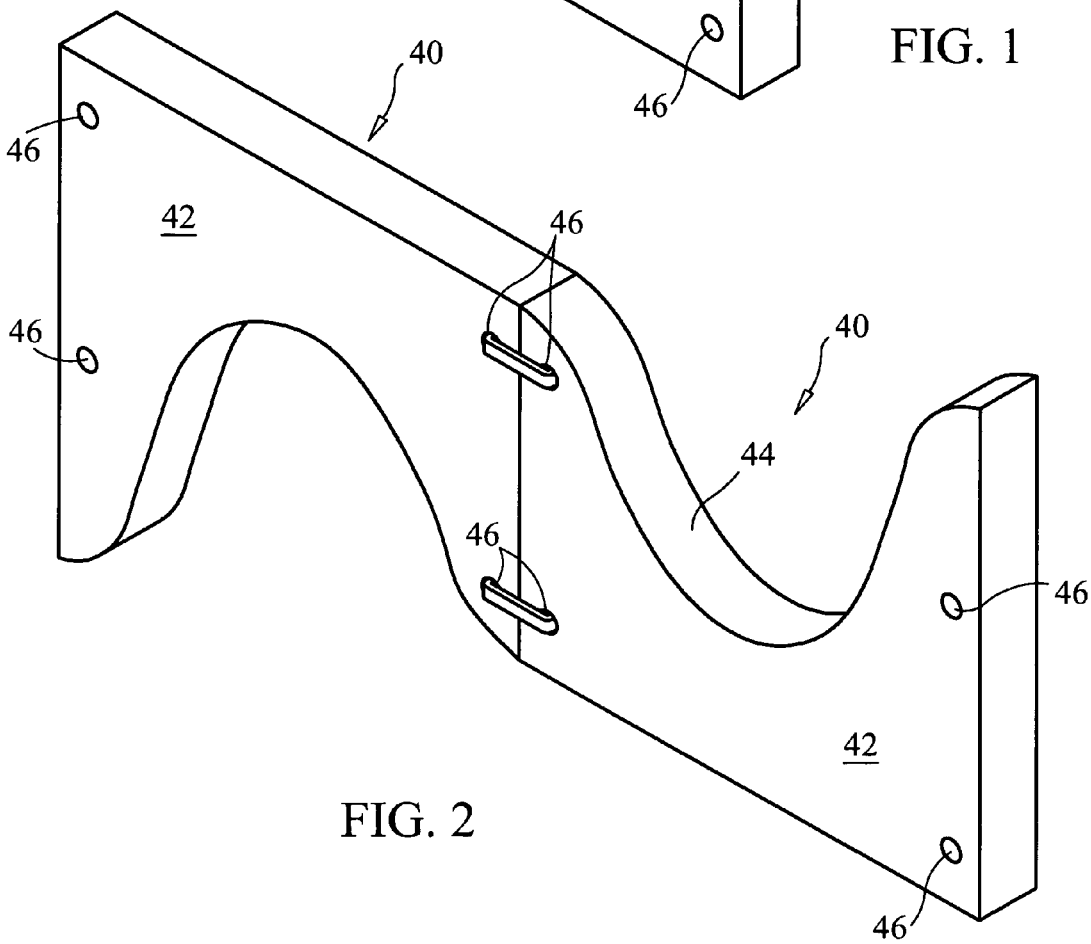
FIG. 2 is a perspective view of a first combination of frame members.
Figure 3:
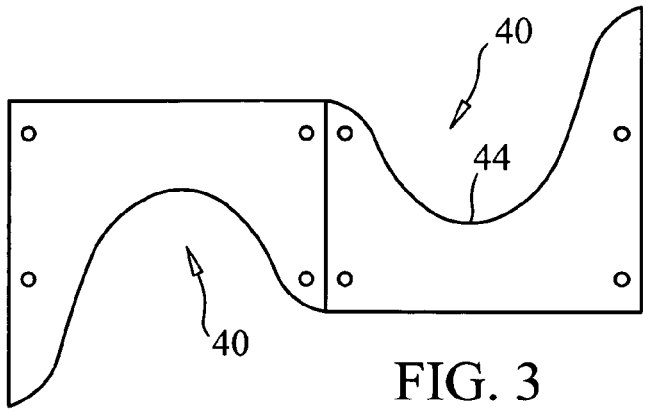
FIG. 3 is a front view of the first combination of frame members shown in FIG. 2.
Figure 4:
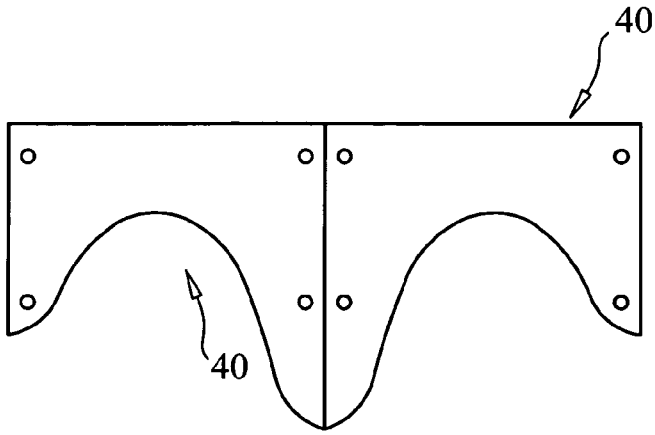
FIG. 4 is a front view of a second combination of frame members.
Figure 5:
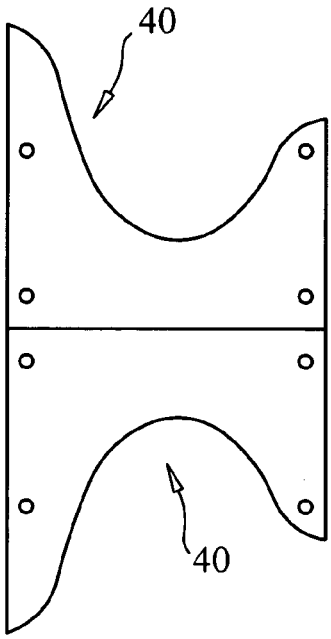
FIG. 5 is a front view of a third combination of frame members.
Figure 6:
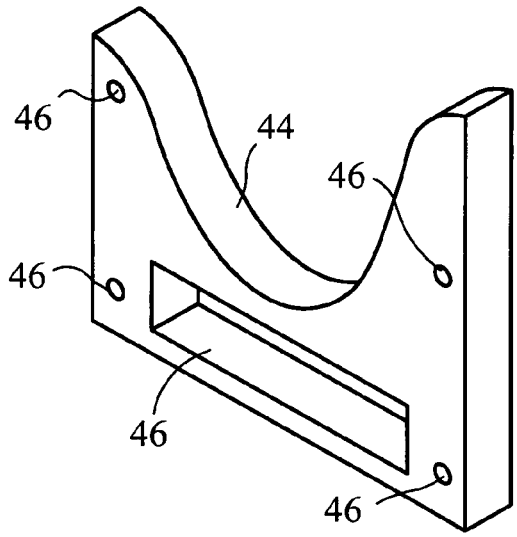
FIG. 6 is a perspective view of a frame member in accordance with the present invention with a portion of the body cutout to reduce material and weight.
Figure 7:
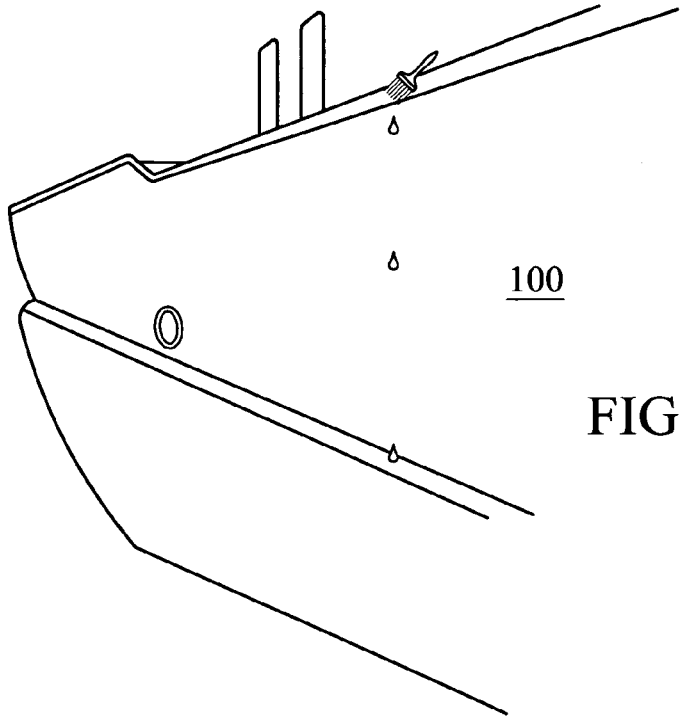
FIG. 7 is a perspective view of a marine vessel being treated with varnish with the use of the present invention.

As seen in the drawings a material receiving and retaining bib having a quick attachable/detachable frame assembly for positioning the bib in a desired location is provided for receipt of material (i.e. fluids, excess varnish, cleaners, compositions, chemicals, etc.) which may drip or fall off of the surface (i.e. handrail, etc.) to which the material is being applied to. The entire assembly (bib and frame members) is generally designated as reference numeral 10. The bib is generally designated as reference numeral 20 and each frame member is generally designated as reference numeral 40.

A plurality of quickly attachable/detachable frame members 40 are quickly and easily attached to a surface 100 of a marine vessel or other desired location, preferably in a non-invasive manner with respect to surface 100 (i.e. no holes in or drilling into surface 100). Frame member 40 includes a body 42 having a bib supporting surface 44. The shape of bib supporting surface 44 is not limited to any particular shape. However, in a preferred, non-limiting embodiment, surface 44 is of a substantially "C" "U" or "J" shape or some other substantially curved or rounded shape. Though other shapes which will sufficiently secure retaining bib 20 to frame member 40 can also be used and are considered within the scope of the invention.

Frame member 40 can be provided with one or more apertures, slots and/or holes (collectively referred to as apertures 46) which can be used in attaching frame member 40 to a marine vessel or other object (i.e. to a post, pole by an inserted cable, rope, tie, etc.), attaching bib 30 to frame member 40 and/or attaching one frame member 40 to another frame member 40. At least one aperture 46 in frame member 40 can be used for feeding a line or other cord-like material. The use of the line or cord-like material through the various frame members 40 can aid in retaining a frame member 40 from falling (such as into the water) in case it gets disconnected from the boat hull or other surface it may be attached to.

Frame member 40 can be constructed from various substantially rigid materials, including, but not limited to, wood, plastic, metal, Styrofoam, etc.

Frame member 40 also includes a first end surface 48 and a second end surface 50.

Figure 12:
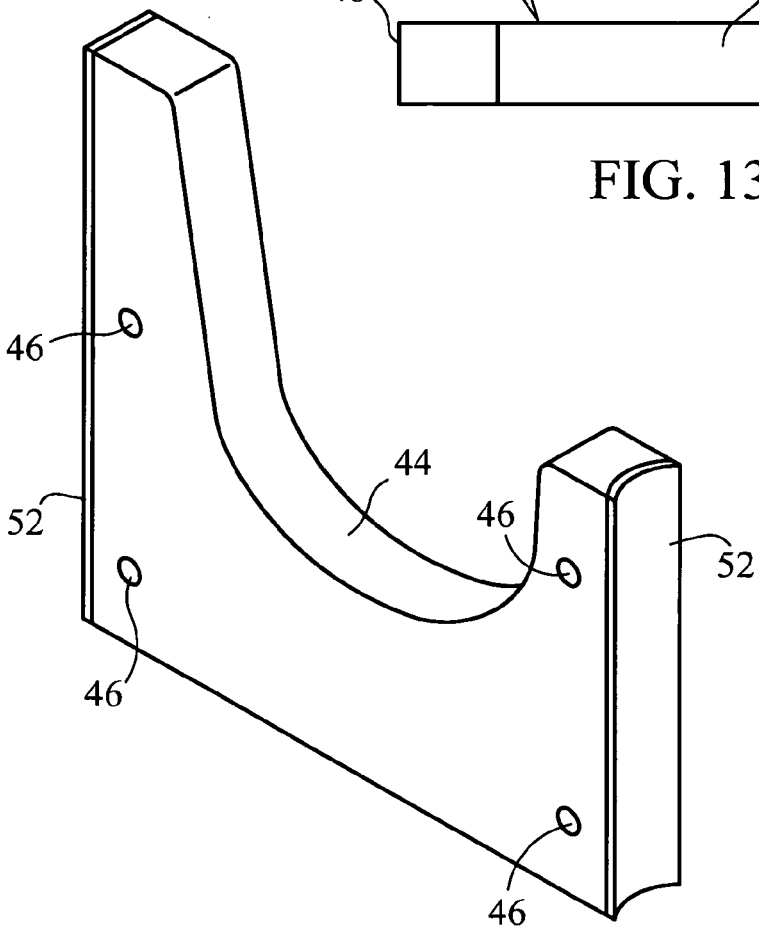
FIG. 12 is a perspective view of a frame member in accordance with the present invention showing a rounded end surface.

In a first embodiment, a magnetic strip 52 can be disposed at first end surface 48 and/or second end surface 54 for attaching frame member 40 to a magnetic surface, such the hull surface area of a marine vessel. Though not limiting, one or both end surface of frame member 40 can be substantially rounded or curved in shape (See FIG. 12) to permit a larger area of the end surface to come in contact with a rounded surface on the marine vessel or other object (i.e. when attaching frame member 40 to a post, pole, stauchin, etc.). Where magnetic strip 52 is used with the curved end surface, magnetic strip 52 can also be curved.

Other frame attachment methods can be used and are considered within the scope of the invention. Some of these methods includes but are not limited to hook and loop fasteners, hot glue, glues, adhesives, caulking, tape, double-sided tapes, etc. Where hook and loop fasteners are used a first fastener can be attached to one of the end surfaces 48 or 50 and a mating second fastener secured to the marine vessel or other desired location. To prevent the hot glues and other adhesives from possibly damaging the marine vessel or other desired object, a piece of tape can be applied to the marine vessel (or other desired location) and the hot glue or other adhesive applied on the tape and/or the end surface 48 or 50 of frame member 40. End surface 48 or 50 is then positioned to be secured to the piece of tape when attaching frame member 40, thus, eliminating or reducing the amount of hot glue or other adhesive that directly contacts the marine vessel or other desired object. The hook and loop fastener which may be provided on end surface 48 and/or surface 50 for attachment purposes can be permanently attached to such surface(s), while the mating fastener attached to the marine vessel or object would be removed from vessel 100 or object after the servicing job has been finished and/or the applied material has dried.

Figure 13:
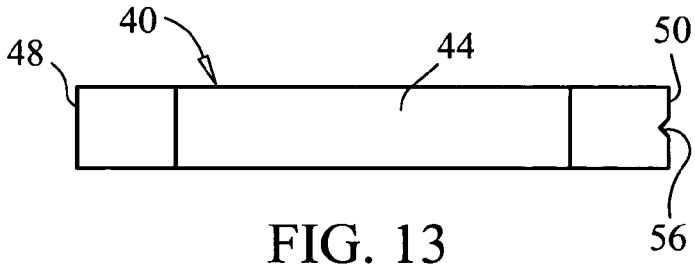
FIG. 13 is a top view of the present invention showing one end surface having a groove for receipt of extra adhesive material.

End surfaces 48 and/or 50 can also be provided with a groove or slot 56, which can be substantially v-shaped (See FIG. 13) or u-shaped or any other shape which can permit additional adhesive to be provided at end surface 49 and/or 50 for attaching frame member 40 to marine vessel 100 or other object.

Bib 20 is positioned and attached to frame member 40 such that it will catch and retain excess materials falling from the object being serviced or treated such as a wooden rail or any another item on the marine vessel or other object.

In one non-limiting example, the material is excess varnish that may drip or otherwise fall or run from a wooden cap rail located on the marine vessel. However, other materials can also be caught and retained by the present invention and are all considered within the scope of the invention.

Figure 8:
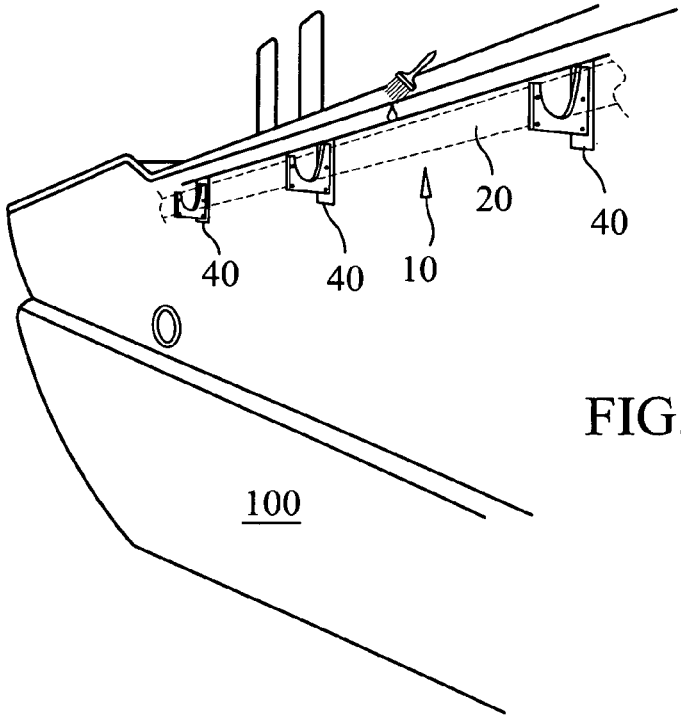
FIG. 8 is a perspective view of a marine vessel being treated with varnish with the present invention attached to the marine vessel to catch and dripping varnish.
Figure 9:
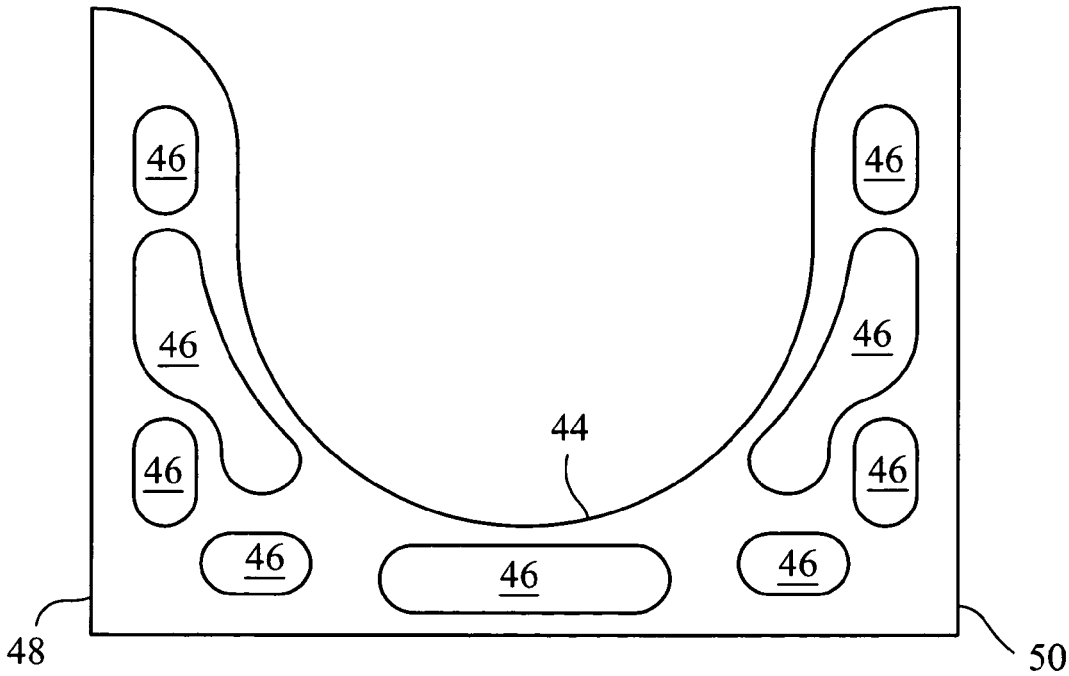
FIG. 9 is front view of a frame member with additional apertures as compared to the frame member in FIG. 1.
Figure 10:
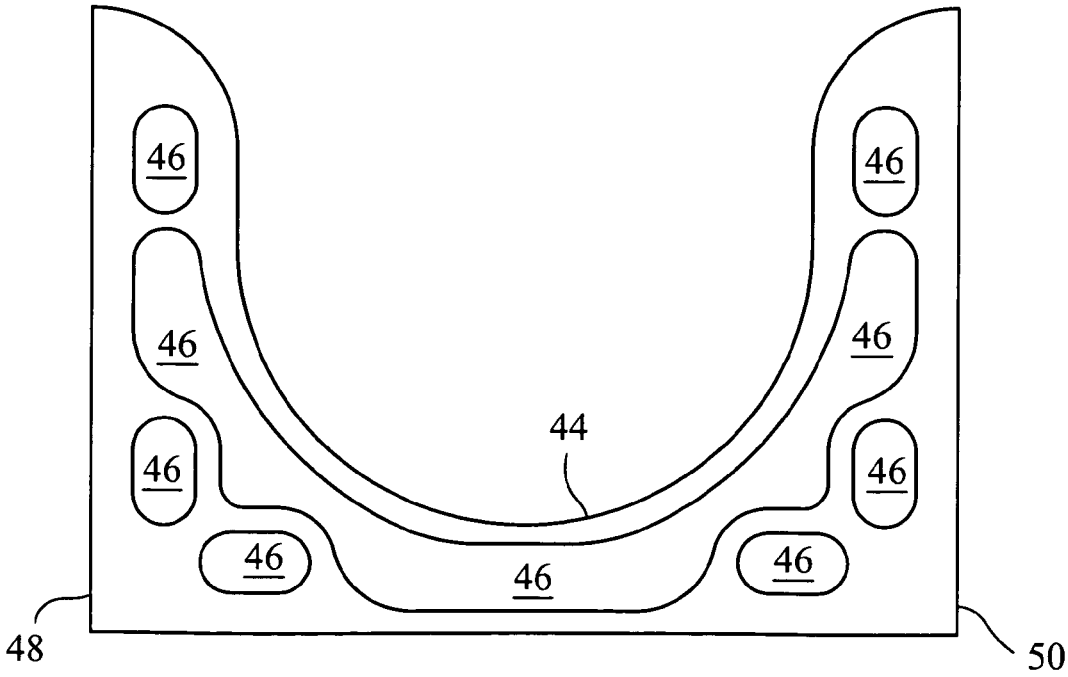
FIG. 10 is a front view of another frame member with additional apertures as compared to the frame member in FIG. 1.
Figure 11:
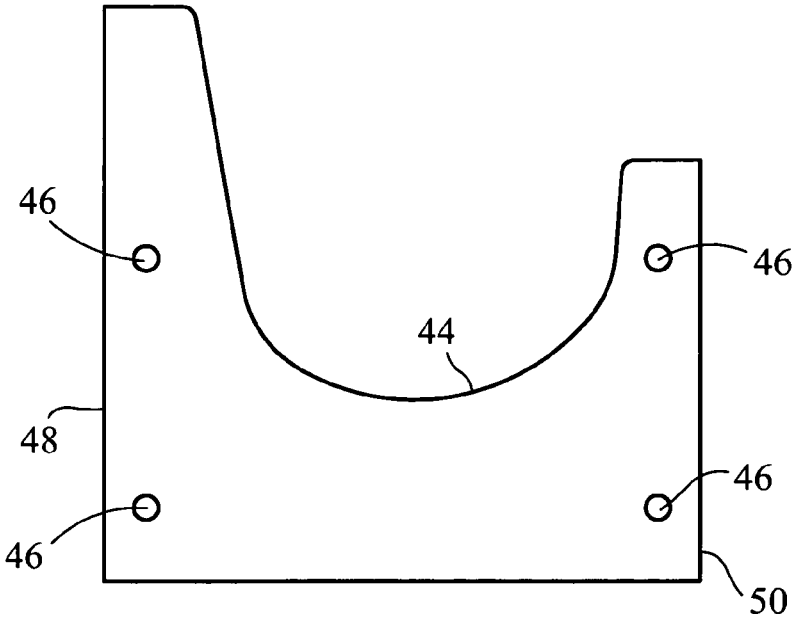
FIG. 11 is a front view of one embodiment of a frame member in accordance with the present invention.

As seen in FIG. 8, preferably frame members 40 are attached to the marine vessel or other object at a spaced-apart distance from each other by any one or more of the attachment methods discussed above. As also mentioned above, various conventional methods can be used for attaching retaining bib 20 to frame members 40 and/or retaining bib 20 itself can be self adhesive for direct attachment to frame members 40.

As seen in FIGS. 2–5 combination of frame members 40 can be used for particular purposes, namely, side by side to provide a flat shelf (See FIG. 4) for receipt of bib 20 or for supporting tools, other items, etc; second frame member 40 positioned underneath first frame member 40 which receives retaining bib 20, for providing additional support to first frame member 40 (See FIG. 5); second frame member 40 serves as an extension for first frame member 40 that receives retaining bib 20 (See FIG. 3) which may be desirable for curved or bowed surfaces or other areas. Other combinations are also possible and considered within the scope of the invention. The frame members can be attached to either by various conventional methods including cable ties, rope or cording through apertures 46, adhesives, tapes, hook and loop fasteners, caulking, etc. and all are considered within the scope of the invention.

Figure 14:
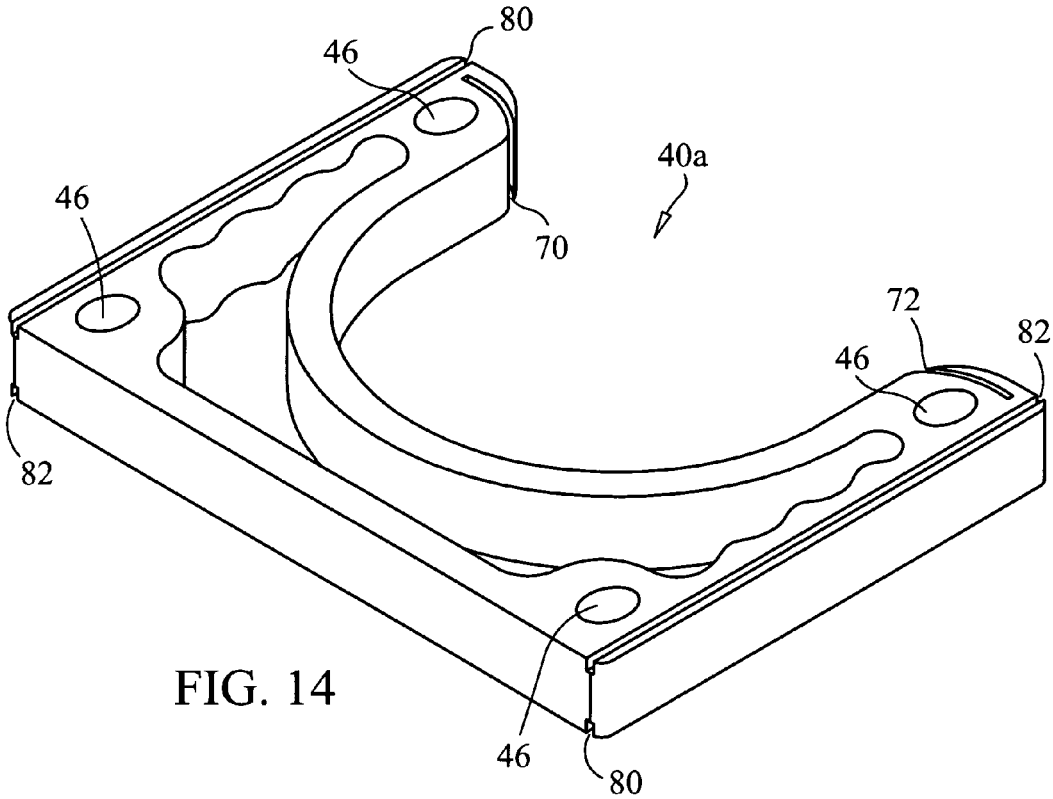
FIG. 14 is a perspective view of a further embodiment for the frame member in accordance with the present invention.
Figure 15:
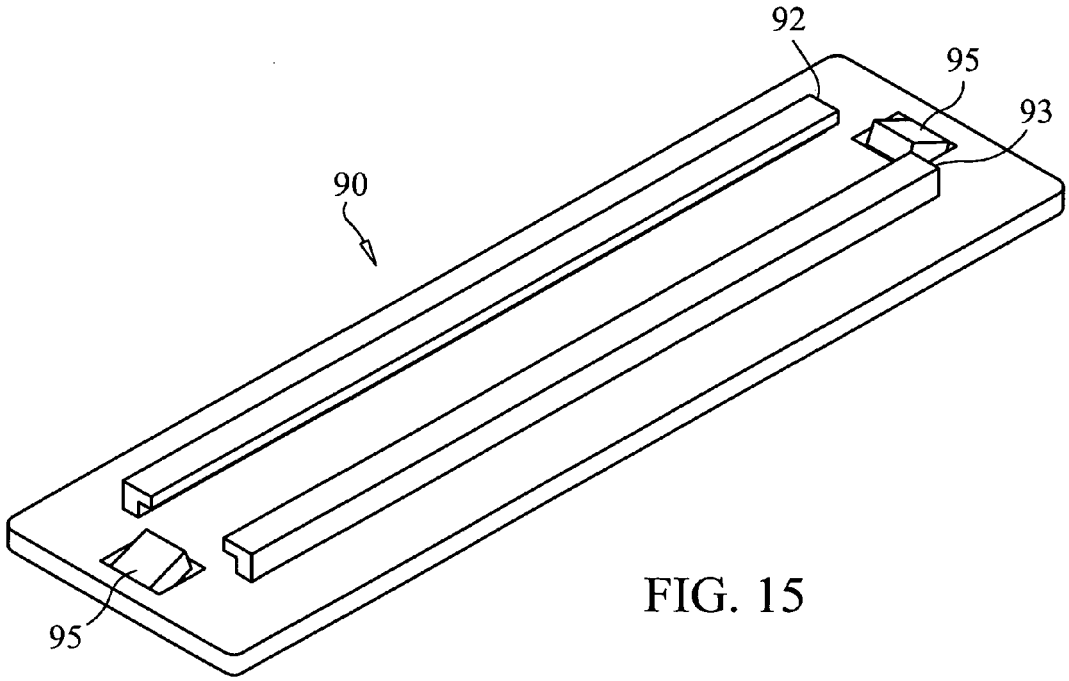
FIG. 15 is a perspective view of a mounting bracket which can be used in connection with the frame member of FIG. 14.

As seen in FIG. 14 a further embodiment for the frame member is shown and generally referenced as frame member 40*a*. Frame 40*a* for the most part is constructed and operates in a same or similar fashion as to the other frame embodiments disclosed above for present invention. Thus, frame member 40*a* includes tie ports (i.e. for receipt of cable ties, etc.) or apertures 46*a*. Additionally, though not shown, frame member 40*a* can include magnetic strips, rounded surface areas, V slot, etc. and other features similar to those described for the other frame embodiments. Frame 40*a* can be provided with bib retaining slots 70 and 72 which receive portions of the material catch or drip bib (as well as any other item held by frame member 40*a* used to catch any falling liquid or material). Slots 70 and 72 help maintain and retain the drip bib in place. Though slots 70 and 72 should be sufficient for retaining the corresponding portion of the bib disposed therein, additional adhesives, tapes, etc. can be used for attached the bib portion to frame member 40*a* after the bib portions have been inserted into slots 70 and 72. Frame 46*a* can also be provided with at least one, and preferably two pairs of slots 80 and 82 which can be used in conjunction with a mounting bracket 90 (See FIG. 15) to mount frame member 40*a* to a vessel, etc.

With the use of mounting bracket 90, a stronger connection for frame member 40*a* to the vessel is provided, since mounting bracket provides a larger surface area for contact with the vessel as compared to one of the ends of frame member 40*a*. Bracket member 90 includes male track portions 92 and 93 which are received in one pair of female slots 80 and 82 of frame member 40*a*. At least one and preferably two reflex snap locks 95 can be provided on mounting bracket 90 which helps to retain the attachment of frame member 40*a* to mounting bracket 90, once male track portions have fed into female slot 80 and 82. Where two snap locks 95 are provided, frame member 40*a*, when properly attached to mounting bracket 90, is disposed between the two snap locks. Other protrusions extending outward from mounting bracket 90 can also be used in lieu of snap locks 95 and are also considered within the scope of the invention.

The mounting bracket 90 can be attached to the vessel or other object by any known means, and all the means disclosed above for attaching frame member 40 or 40*a* directly to the vessel can be used such as, but not limited to, adhesives, tapes or hook and loop fasteners, etc.

In use the frame members are attached to the desired location of the marine vessel or other object such that they are positioned underneath the area of the boat to be serviced. Once the frame members are attached by one of the above-described methods or some other conventional method, the bib is then attached to the frame member by one of the above-described methods or some other conventional method. Any excess material dripping from the treated object is caught and retained within the bib prior to touching a non-desired area of the vessel or before entering a body of water the vessel may be residing in.

Thus, the frame members are quickly attachable to marine vessel 100 or other object, as well as quickly detachable from such vessel or other object. Additionally, the frame members are preferably attached in a non-invasive manner (i.e. no holes in the vessel or surface).

It is also within the scope of the invention that more than one bib is provided and attached to the frame members either in a side by side relationship or in an overlapping relationship.

It is also further within the scope of the invention that different embodiments of the frame members are used together (i.e. some of frame member 40 and some of frame member 40*a*, etc.).

The frame members and bib can be sold and marketed as a complete unit or can be sold individually. The frame members and/or bib can be used for other purposes particularly where it is desired to attached a frame member to a surface without invading the surface (i.e. invasion through drilling holes, screwing in screws or bolts, etc.).

The term bib is considered to be broad and include any item which can catch and retain falling material and that can be properly positioned with respect to a marine vessel or other intended object by the frame members of the present invention.

Knowing, that the present invention is in place to catch and retain any falling material, the individual servicing marine vessel 100 or other object, can be liberal in applying the material, which should provide a better treatment of the serviced object.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An attachment assembly for positioning a bib with respect to a marine vessel or other object for use to catch falling material or liquid being applied to a marine vessel, said attachment assembly comprising:

at least one pair of frame members, wherein each pair of frame members comprising a first frame member and a second frame member; each frame member having a first end and a second end and a substantially inwardly curved shaped top supporting surface disposed between said first end and said second end;

wherein the first frame member and the second frame member are attached to a marine vessel in a spaced apart position from each other, wherein the attachment of each frame member to said marine vessel is non-invasive to an area of the marine vessel where the frame member is attached; and a bib member having a first portion attached to and disposed on the top supporting surface of said first frame member and a second portion attached to and disposed on the top supporting surface of said second frame member, said bib member retained and supported in position by said first frame member and said second frame member with respect to the marine vessel;

wherein the attachment of the bib member to the inwardly curved shaped top supporting surfaces of said first frame member and said second frame member creates a curved catch area for said bib member which catches falling material or liquid being applied to the marine vessel and prevents the caught falling material or liquid from escaping into a surrounding area.

2. The attachment assembly of claim 1 wherein said first frame member and said second frame member are non-invasively attached to a portion of a hull area of the marine vessel.

3. The attachment assembly of claim 2 further comprising;

a first hook and loop portion disposed on the first portion of the hull area and a mating second hook and loop portion disposed on a first end of said first frame member, wherein said first frame member is non-invasively attached to the first portion of the hull area by mating the first hook and loop portion with the second hook and loop portion; and a third hook and loop portion disposed on the second portion of the hull area and a mating fourth hook and loop portion disposed on a first end of said second frame member, wherein said second frame member is non-invasively attached to the second portion of the hull area by mating the third hook and loop portion with the fourth hook and loop portion.

4. The attachment assembly of claim 1 wherein said first frame member is non-invasively attached to the marine vessel by a first double sided tape attached on a first side at a first end of said first frame member and a second side to the marine vessel and said second frame member is non-invasively attached to the marine vessel by a second double sided tape attached on a first side at a first end of said second frame member and a second side to the marine vessel.

5. The attachment assembly of claim 1 wherein at least a portion of a first end of at least one frame member includes a magnetic member attached thereto for directly attaching said at least one frame member in a non-invasive manner to the marine vessel and quickly detaching said at least one frame member.

6. The attachment assembly of claim 1 wherein at least one end of at least one frame member is inwardly curved in shape.

7. The attachment assembly of claim 1 wherein a first end of at least one frame member includes a slot extending from a bottom surface to a top surface of the first end of said least one frame member.

8. The attachment assembly of claim 1 wherein the top supporting surface of said first frame member including a pair of slots for receiving first and second portions of the bib and the top supporting surface of said second frame member including a pair of slots for receiving third and fourth portions of the bib.

9. The attachment assembly of claim 1 furthering comprising a first mounting bracket non-invasively attached to a first portion of a hull area of the marine vessel and a second mounting bracket non-invasively attached to a second portion of a hull area of the marine vessel, wherein said first frame member is removably attached to said first mounting bracket and said second frame member is removably attached to said second mounting bracket.

10. The attachment assembly of claim 9 further comprising:

a first hook and loop portion disposed on the first portion of the hull area and a mating second hook and loop portion disposed on a first end of said first mounting bracket, wherein said first mounting bracket is non-invasively attached to the first portion of the hull area by mating the first hook and loop portion with the second hook and loop portion; and a third hook and loop portion disposed on the second portion of the hull area and a mating fourth hook and loop portion disposed on a first end of said second mounting bracket, wherein said second mounting bracket is non-invasively attached to the second portion of the hull area by mating the third hook and loop portion with the fourth hook and loop portion.

11. The attachment assembly of claim 9 wherein said first mounting bracket having a male track which includes a first track portion and a second track portion and said second mounting bracket having a male track which includes a first track portion and a second track portion; wherein said first frame member having a first groove and a second groove disposed near at least one end that extend at least a substantial portion of a vertical length of said at least one end of said first frame member and said second frame member having a first groove and a second groove disposed near at least one end that extend at least a substantial portion of a vertical length of said at least one end of said second frame member; wherein when attaching said first frame member to said first mounting bracket said first track portion of said first mounting bracket is disposed within said first groove of said first frame member and said second track portion of said first mounting bracket is disposed within said second groove of said first frame member; wherein when attaching said second frame member to said second mounting bracket said first track portion of said second mounting bracket is disposed within said first groove of said second frame member and said second track portion of said second mounting bracket is disposed within said second groove of said second frame member.

12. The attachment assembly of claim 11 wherein said first mounting bracket further comprising a first protrusion disposed at a first end of said male track portion and a second protrusion disposed at a second end of said male track portion, wherein when said first frame member is properly attached to said first mounting bracket said first frame member is disposed and retained between said first protrusion and said second protrusion; wherein said second mounting bracket further comprising a first protrusion disposed at a first end of said male track portion and a second protrusion disposed at a second end of said male track portion, wherein when said second frame member is properly attached to said second mounting bracket said second frame member is disposed and retained between said first protrusion and said second protrusion.

13. The attachment assembly of claim 1 wherein a vertical length of said first end of said first frame member is longer than a vertical length of said second end of said first frame member and a vertical length of said first end of said second frame member is longer than a vertical length of said second end of said second frame member.

14. An attachment assembly for positioning a bib with respect to a marine vessel or other object for use to catch falling material or liquid being applied to a marine vessel, said attachment assembly comprising:

at least one pair of frame members, wherein each pair of frame members comprising a first frame member and a second frame member; each frame member having a first end and a second end and a substantially inwardly curved shaped top supporting surface disposed between said first end and said second end;

a first mounting bracket attached in a non-invasive manner to a marine vessel, said first frame member removably attached to said first mounting bracket;

a second mounting bracket attached in a non-invasive manner to the marine vessel in a spaced relationship from said first mounting bracket, said second frame member removably attached to said mounting bracket; and a bib member having a first portion attached to and disposed on the top supporting surface of said first frame member and a second portion attached to and disposed on the top supporting surface of said second frame member, said bib member retained and supported in position by said first frame member and said second frame member with respect to the marine vessel;

wherein the attachment of the bib member to the inwardly curved shaped top supporting surfaces of said first frame member and said second frame member creates a curved catch area for said bib member which catches falling material or liquid being applied to the marine vessel and prevents the caught falling material or liquid from escaping into a surrounding area.

15. The attachment assembly of claim 14 wherein said first mounting bracket is non-invasively attached to a first portion of a hull area of the marine vessel and said second mounting bracket is non-invasively attached to a second portion of the hull area of the marine vessel.

16. The attachment assembly of claim 15 further comprising:

a first hook and loop portion disposed on the first portion of the hull area and a mating second hook and loop portion disposed on a first end of said first mounting bracket, wherein said first mounting bracket is non-invasively attached to the first portion of the hull area by mating the first hook and loop portion with the second hook and loop portion; and a third hook and loop portion disposed on the second portion of the hull area and a mating fourth hook and loop portion disposed on a first end of said second mounting bracket, wherein said second mounting bracket is non-invasively attached to the second portion of the hull area by mating the third hook and loop portion with the fourth hook and loop portion.

17. The attachment assembly of claim 15 wherein said first mounting bracket is non-invasively attached to the first portion of the hull area by a first double sided tape attached on a first side to a first end of said first mounting bracket and a second side to the first portion of the hull area and said second mounting bracket is non-invasively attached to the second portion of the hull area by a second double sided tape attached on a first side at a first end of said second mounting bracket and a second side to the second portion of the hull area.

18. The attachment assembly of claim 14 wherein said first mounting bracket having a male track which includes a first track portion and a second track portion and said second mounting bracket having a male track which includes a first track portion and a second track portion; wherein said first frame member having a first groove and a second groove disposed near at least one end that extend at least a substantial portion of a vertical length of said at least one end of said first frame member and said second frame member having a first groove and a second groove disposed near at least one end that extend at least a substantial portion of a vertical length of said at least one end of said second frame member; wherein when attaching said first frame member to said first mounting bracket said first track portion of said first mounting bracket is disposed within said first groove of said first frame member and said second track portion of said first mounting bracket is disposed within said second groove of said first frame member; wherein when attaching said second frame member to said second mounting bracket said first track portion of said second mounting bracket is disposed within said first groove of said second frame member and said second track portion of said second mounting bracket is disposed within said second groove of said second frame member.

19. The attachment assembly of claim 18 wherein said first mounting bracket further comprising a first protrusion disposed at a first end of said male track portion and a second protrusion disposed at a second end of said male track portion, wherein when said first frame member is properly attached to said first mounting bracket said first frame member is disposed and retained between said first protrusion and said second protrusion; wherein said second mounting bracket further comprising a first protrusion disposed at a first end of said male track portion and a second protrusion disposed at a second end of said male track portion, wherein when said second frame member is properly attached to said second mounting bracket said second frame member is disposed and retained between said first protrusion and said second protrusion.

20. The attachment assembly of claim 14 wherein the top supporting surface of said first frame member including a pair of slots for receiving first and second portions of the bib and the top supporting surface of said second frame member including a pair of slots for receiving third and fourth portions of the bib.

* * * * *

UNITED STATES PATENT AND TRADEMARK OFFICE

CERTIFICATE OF CORRECTION

PATENT NO. : 7,007,627 B1
DATED : March 7, 2006
INVENTOR(S) : Scott Van Allen

It is certified that error appears in the above-identified patent and that said Letters Patent is hereby corrected as shown below:

Title page,
Item [75], Inventor, last name should read -- Van Allen --.
Item [74], *Attorney, Agent, or Firm*, should read -- Daniel S. Polley, P.A. --.

Signed and Sealed this

Second Day of May, 2006

JON W. DUDAS
*Director of the United States Patent and Trademark Office*